US006966556B1

(12) United States Patent
Culley et al.

(10) Patent No.: US 6,966,556 B1
(45) Date of Patent: Nov. 22, 2005

(54) WORD BUILDING AND SPELLING CARD GAME

(76) Inventors: Geoffrey B. Culley, 6 Woodrow Way, Greenstead, Colchester, Essex (GB); Jason J. Barry, 34 Chatsworth Road, West Mersea, Colchester, Essex (GB)

( * ) Notice: Subject to any disclaimer, the term of this patent is extended or adjusted under 35 U.S.C. 154(b) by 44 days.

(21) Appl. No.: 10/729,766

(22) Filed: Dec. 8, 2003

(51) Int. Cl.[7] ..... A63F 1/04
(52) U.S. Cl. ..... 273/272; 273/299
(58) Field of Search ..... 273/272, 429, 273/430, 431, 432, 292, 299, 302; 434/159, 434/171, 172, 167

(56) References Cited

U.S. PATENT DOCUMENTS 3,606,336 A * 9/1971 Krause ..... 273/272
4,222,561 A * 9/1980 Whitten ..... 273/429
4,350,342 A 9/1982 Barulich
4,690,409 A * 9/1987 Scalia ..... 273/299
4,776,802 A 10/1988 Rind et al.
4,934,711 A * 6/1990 Runstein ..... 273/272
4,955,614 A 9/1990 Buda
5,409,237 A * 4/1995 Marcley et al. ..... 273/299
5,429,371 A * 7/1995 Bledsoe ..... 273/272
5,507,495 A * 4/1996 Kiss ..... 273/243

* cited by examiner

*Primary Examiner*—William M. Pierce
(74) *Attorney, Agent, or Firm*—Donald R. Schoonover

(57) ABSTRACT

A card game is used to teach spelling and word building. The card game includes letter cards, number cards and category cards. Each player is dealt a certain number of cards and must build a word that fits into a category set forth on a selected category cards using the number of letters set forth on a selected number card.

8 Claims, 2 Drawing Sheets

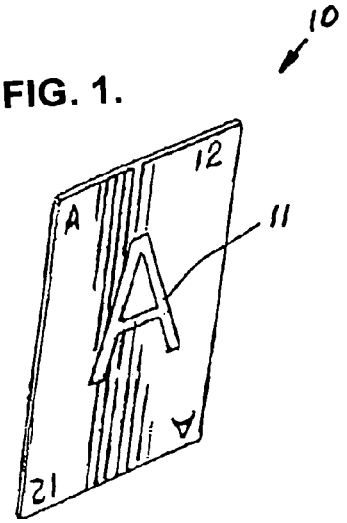
FIG. 1.
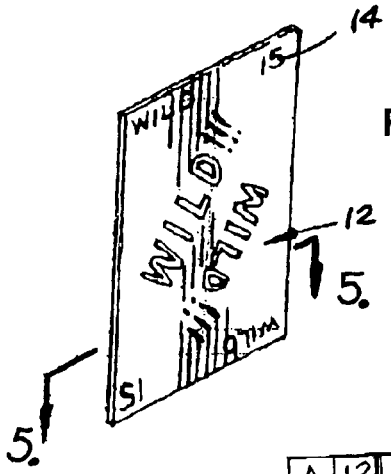
FIG. 2.
FIG. 6.
| | | | | | |
|---|---|---|---|---|---|
| A | 12 | J | 11 | S | 5 |
| B | 2 | K | 10 | T | 8 |
| C | 4 | L | 6 | U | 12 |
| D | 5 | M | 2 | V | 9 |
| E | 12 | N | 9 | W | 8 |
| F | 3 | O | 12 | X | 1 |
| G | 7 | P | 7 | Y | 6 |
| H | 10 | Q | 4 | Z | 1 |
| I | 12 | R | 3 | WILD | 15 |
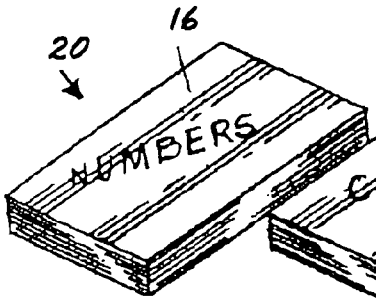
FIG. 3.
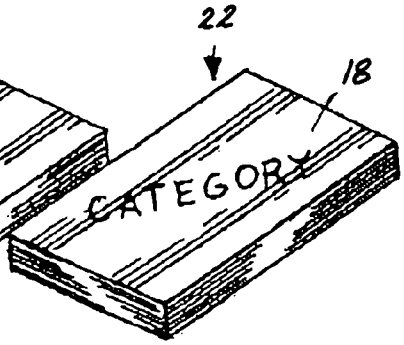
FIG. 4.
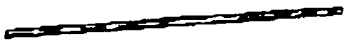
FIG. 5.

WORD BUILDING AND SPELLING CARD GAME

BACKGROUND OF THE INVENTION

1. Field of the Invention

The present invention relates to the general art of amusement devices and games, and to the particular field of word forming games.

2. Discussion of the Related Art

Both children and adults are often interested in expanding their knowledge. For this reason, the art contains many examples of teaching devices. One way of teaching is through the use of games. The art thus contains many examples of educational games. For example, there are memory games, math games, reading games, and the like.

Vocabulary and spelling are often very important skills required for education. A large vocabulary will permit a person to understand written and spoken instructions and information. A skilled speller is often able to communicate their ideas and thoughts more effectively than someone who struggles with spelling. Accordingly, it is very desirable to teach spelling, word use, and word building to anyone who desires to assimilate and communicate information. As mentioned above, teaching of skills is often carried out using games, especially for children.

Therefore, there is a need for an educational game that teaches words and word building, as well as spelling.

Since many children enjoy playing card games and are introduced to card games at an early age, the use of a card game to teach a skill, especially an educational skill, is desirable for both the teacher and the learner.

Therefore, there is a need for an educational card game that teaches words and word building as well as spelling.

As mentioned above, it is desirable to improve spelling and word building skills for all ages, not just children. Many adults can profit by improving these skills, especially if the adult is learning a new language. Some families have adults and children all wishing to improve these skills. Accordingly, it would be desirable to have a teaching tool that can be used by both adults and children to teach spelling and word building skills.

Therefore, there is a need for an educational card game that teaches words and word building as well as spelling that can be played by players of all ages and skill levels.

Some people may acquire these skills quicker than others. Therefore, in order to keep all people equally interested in learning these skills, it would be desirable to be able to handicap those with superior skills so all will have an equal chance of winning, and thus being positively reinforced.

Therefore, there is a need for an educational card game that teaches words and word building as well as spelling and which can be easily modified to account for different player skill levels.

PRINCIPAL OBJECTS OF THE INVENTION

It is a main object of the present invention to provide an educational game that teaches words and word building as well as spelling.

It is another object of the present invention to provide an educational card game that teaches words and word building as well as spelling that can be played by players of all ages and skill levels.

It is another object of the present invention to provide an educational card game that teaches words and word building as well as spelling and which can be easily modified to account for different player skill levels.

SUMMARY OF THE INVENTION

These, and other, objects are achieved by a method of playing an educational card game which comprises providing a plurality of letter cards, a plurality of wild cards, with each letter card and each wild card having a numerical value; providing a plurality of number cards; providing a plurality of category cards, each category card having a category thereon; shuffling the letter cards; shuffling the number cards and placing the shuffled number cards in a stack of number cards; shuffling the category cards and placing the shuffled category cards in a stack of category cards; selecting a number card from the stack of number cards and identifying the number on the selected card as the number of cards to be initially dealt to each player; dealing letter cards from the shuffled deck of letter cards to each player until each player has a number of cards held in his or her hand that equals the number on the selected number card; replacing the remaining letter cards in a stack that is accessible to all players; selecting a category card from the stack of category cards and turning that card face up so all players can view the selected category card; setting a goal by using the selected category card and the selected number card, the goal being to form a word related to the category on the selected category card using the number of letter cards that corresponds to the number on the selected number card; having each player in turn pick a card from either the stack of remaining letter cards or from a card that has been discarded by the player immediately preceding the player and then discard a letter card from his or her hand; proceeding until one player forms a winning word that is related to the selected category using a number of letter cards that corresponds to the number on the selected number card; designating the one player as the winning player; and using the numbers on the letter cards, awarding points to the winning player by adding the number of points in the letters used to form the winning word.

The game embodying the present invention will teach the players word forming skills, spelling and vocabulary. The game can be modified to fit all skill levels, even if those playing a game have different skill levels. Thus, the game will be educational and fun for all.

BRIEF DESCRIPTION OF THE DRAWING FIGURES

FIG. 1 is a perspective view of a numbered letter card used in the game embodying the present invention.

FIG. 2 is a perspective view of a wild card used in the game embodying the present invention.

FIG. 3 is a perspective view of a stack of number cards used in the game embodying the present invention.

FIG. 4 is a perspective view of a stack of category card used in the game embodying the present invention.

FIG. 5 is a sectional view taken along line 5—5 of FIG. 2.

FIG. 6 is a table showing the value of the cards used in the game embodying the present invention.

DETAILED DESCRIPTION OF THE PREFERRED EMBODIMENT

Figure 7:
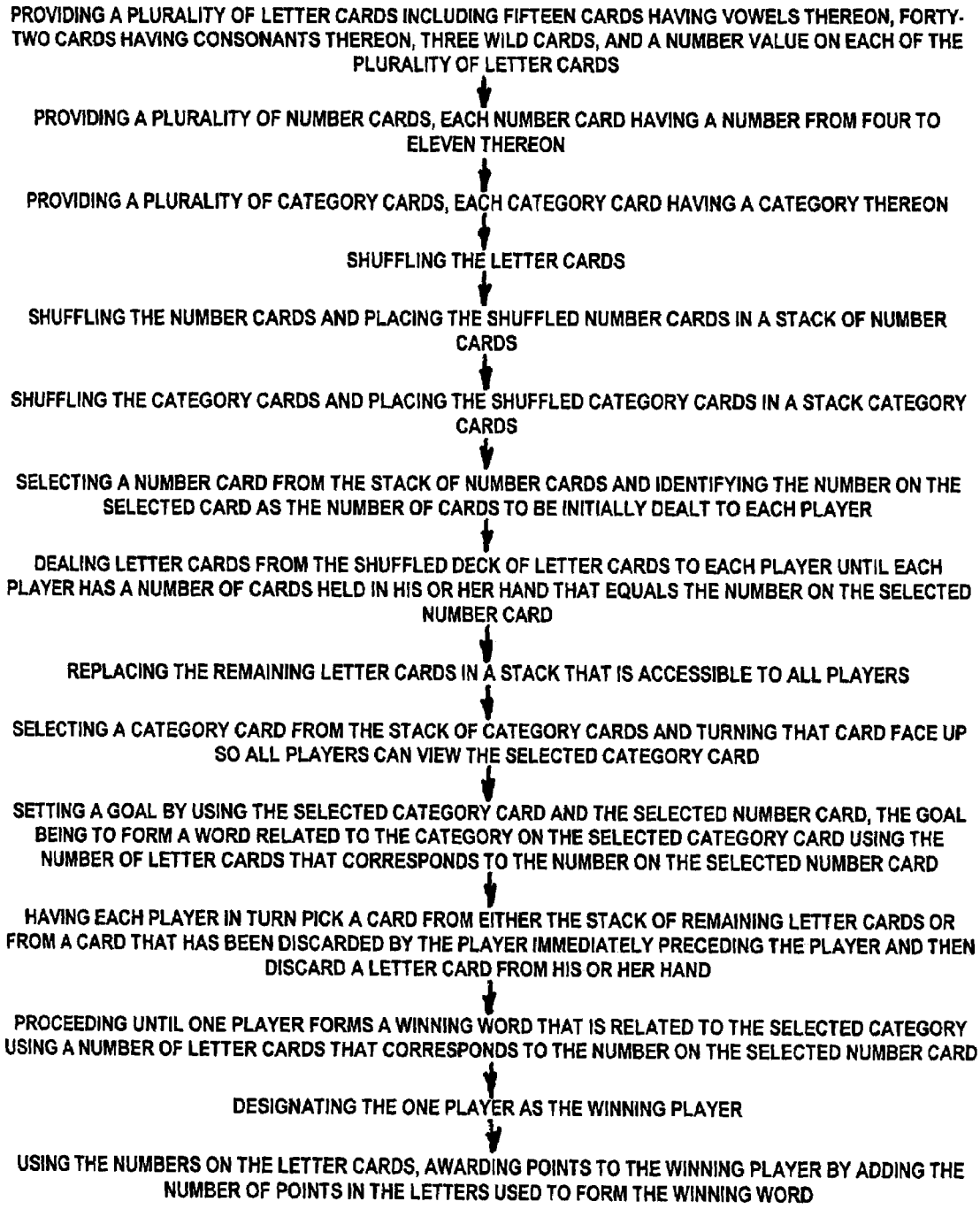
FIG. 7 is a flow chart of the game embodying the present invention.

Other objects, features and advantages of the invention will become apparent from a consideration of the following detailed description and the accompanying drawings.

Referring to the Figures, it can be understood that the present invention is embodied in an educational game that is played using a plurality of letter cards, such as letter card 10. The letter cards include: fifteen cards having vowels, such as vowel 11, thereon, forty-two cards having consonants thereon and three wild cards, such as wild card 12. A number value, such as number value 14 on card 12, is placed on each of the plurality of letter cards, the number values on each card are shown in FIG. 6.

The game further includes a plurality of number cards, such as number card 16, each number card having a number from four to eleven thereon, and a plurality of category cards, such as category card 18. Each category card has a category named thereon. The form of the game shown includes category cards which include the following categories: food, drinks, wild category, vehicle makers, vehicle models, states, towns, cities, boys' names, girls' names, countries, films/movies, television programs, birds, animals, trees, insects, colors, fruit, vegetables, flowers. Other categories will occur to those skilled in the art based on the teaching of this disclosure, and such other categories are intended to be covered by the scope of this disclosure as well.

The cards are plastic as indicated in FIG. 5 and can be any size with any font size printed thereon as suitable for the age group being targeted. In the form of the game shown, the cards are 3½ inches by 2¼ inches in size.

The game embodying the present invention is played in accordance with the following method steps: providing the above-disclosed cards; shuffling the letter cards; shuffling the number cards and placing the shuffled number cards in a stack of number cards, such as stack 20 shown in FIG. 3; shuffling the category cards and placing the shuffled category cards in a stack of category cards, such as stack 22 shown in FIG. 4; selecting a number card from the stack of number cards and identifying the number on the selected card as the number of cards to be initially dealt to each player; dealing letter cards from the shuffled deck of letter cards to each player until each player has a number of cards in his or her hand that equals the number on the selected number card; replacing the remaining letter cards in a stack that is accessible to all players; selecting a category card from the stack of category cards and turning that card face up so all players can view the selected category card; setting a goal by using the selected category card and the selected number card, the goal being to form a word related to the category on the selected category card using the number of letter cards that corresponds to the number on the selected number card; having each player in turn pick a card from either the stack of remaining letter cards or from a card that has been discarded by the player immediately preceding the player and then discard a letter card from his or her hand; proceeding until one player forms a winning word that is related to the selected category using a number of letter cards that corresponds to the number on the selected number card; designating the one player as the winning player; and using the numbers on the letter cards, awarding points to the winning player by adding the number values of the letters used to form the winning word. As will be understood by those skilled in the art, a wild card can be substituted for any letter card. Also, if the wild category is selected, the person turning over the card can select the category from the other categories or invent a category of his or her own. A flow chart of the game of the present invention is shown in FIG. 7.

An alternative form of the game is to permit a player to use less than the designated number of cards to form a word. This may permit the game to be modified according to skill level of the players. Still further, a player can be permitted to use fewer than the designated number of cards, if that player is willing to lose some of the points awarded for winning. For example, if a player uses five cards to form a word, but the number card selected at the initiation of the game requires six cards to be used, the winning player will have one card remaining in his or her hand. The points on that remaining card will be subtracted from the points that would be otherwise awarded. For example, if the goal is to come up with a seven letter word in the category of animals, but the winning player only plays the word "tiger," and has the letters "W" and "D" remaining in his or her hand, the score ultimately awarded to this player will be 29 points figured as follows (see FIG. 6): [(8 (T)+12 (I)+7 (G)+12 (E)+3 (R))=42], minus [(8 (W) plus 5 (D))=13], with 42−13=29. Only the points of the letters that have been used to create the winning word can be counted in scoring the game.

The game can be modified to fit various skill levels, by requiring older or more skilled players to subtract points as described above while allowing younger or less skilled players to form words of fewer than the set number of letters without penalty. If desired, additional bonus points can be awarded for forming a word using the exact number of cards required (for example coming up with the word "robin" in the category of birds, with the number card stating that the number of letters must be five, a bonus of a certain number of points can be awarded). Certain categories could have additional multipliers associated therewith as well. Such variations will provide additional modifications for the game. Those skilled in the art will understand additional variations based on the teaching of this disclosure.

If desired, the dealer can be issued an extra card during the initial dealing so the dealer will begin the game with a discard. Following players can either pick a card from the stack of letter cards or pick up the card discarded by the immediately preceding player.

If desired, a target number can be selected and each time a player wins, the points awarded to that player are accumulated with any other points that player has and the accumulated points counted towards the target number. The first player to reach the target wins. Furthermore, some players who do not win may have the points on the cards held in his or her hands, when the winning player plays his or her cards, added and subtracted from his or her running total if the game is played to a target number. This will permit the game to be modified according to skill level with, for example, younger or less skilled players being given lower target numbers than older or more skilled players.

It is understood that while certain forms of the present invention have been illustrated and described herein, it is not to be limited to the specific forms or arrangements of parts described and shown.

What is claimed and desired to be covered by Letters Patent is as follows:

1. A method of playing an educational card game comprising:

a) providing a deck of a plurality of letter cards including (1) fifteen cards having vowels thereon, (2) forty-two cards having consonants thereon, (3) three wild cards, and (4) a number value on each of the plurality of letter cards;

b) providing a plurality of number cards, each number card having a number from four to eleven thereon;

c) providing a plurality of category cards, each category card having a category thereon;

d) shuffling the letter cards;

e) shuffling the number cards and placing the shuffled number cards in a stack of number cards;

f) shuffling the category cards and placing the shuffled category cards in a stack of category cards;

g) selecting a number card from the stack of number cards and identifying the number on the selected card as the number of cards to be initially dealt to each player;

h) dealing letter cards from the shuffled deck of letter cards to each player until each player has a number of cards held in his or her hand that equals the number on the selected number card;

i) placing the remaining letter cards in a stack that is accessible to all players;

j) selecting a category card from the stack of category cards and turning that card face up so all players can view the selected category card;

k) setting a goal by using the selected category card and the selected number card, the goal being to form a word related to the category on the selected category card using the number of letter cards that corresponds to the number on the selected number card;

l) having each player in turn pick a card from either the stack of remaining letter cards or from a card that has been discarded by a player immediately preceding the player and then discard a letter card from his or her hand;

m) proceeding until one player forms a winning word that is related to the selected category using a number of letter cards that corresponds to the number on the selected number card;

n) designating the one player as the winning player; and o) using the numbers on the letter cards, awarding points to the winning player by adding the number of points in the letters used to form the winning word.

2. The method as described in claim 1 wherein one player is designated as a dealer, and the dealer is dealt an extra card during the step of dealing letter cards from the shuffled deck of letter cards to each player.

3. The method as described in claim 2 wherein the dealer initiates play by discarding one letter card from their hand.

4. The method as described in claim 3 wherein the goal is modified to permit a word to be formed by less than the number of letter cards than the number on the selected number card.

5. The method as described in claim 4 wherein the numbers on the letter cards remaining in the winning player's hand are subtracted from the points awarded to the winning player.

6. The method as described in claim 3 including setting a target number and adding the points awarded to the winning player each time a game is won and continuing to play additional games until the total points a player has accumulated points that equal or exceed the target number.

7. The method as described in claim 1 further including a step of using a wild card in place of a letter card.

8. A method of playing an educational card game comprising:

a) providing a deck of a plurality of letter cards, a plurality of wild cards, with each letter card and each wild card having a numerical value;

b) providing a plurality of number cards;

c) providing a plurality of category cards, each category card having a category thereon;

d) shuffling the letter cards;

e) shuffling the number cards and placing the shuffled number cards in a stack of number cards;

f) shuffling the category cards and placing the shuffled category cards in a stack of category cards;

g) selecting a number card from the stack of number cards and identifying the number on the selected card as the number of cards to be initially dealt to each player;

h) dealing letter cards from the shuffled deck of letter cards to each player until each player has a number of cards held in their hand that equals the number on the selected number card;

i) placing the remaining letter cards in a stack that is accessible to all players;

j) selecting a category card from the stack of category cards and turning that card face up so all players can view the selected category card;

k) setting a goal by using the selected category card and the selected number card, the goal being to form a word related to the category on the selected category card using the number of letter cards that corresponds to the number on the selected number card;

l) having each player in turn pick a card from either the stack of remaining letter cards or from a card that has been discarded by a player immediately preceding the player and then discard a letter card from his or her hand;

m) proceeding until one player forms a winning word that is related to the selected category using a number of letter cards that corresponds to the number on the selected number card;

n) designating the one player as the winning player; and o) using the numbers on the letter cards, awarding points to the winning player by adding the number of points in the letters used to form the winning word.

* * * * *